US006502371B2

(12) United States Patent
DeMatteis

(10) Patent No.: US 6,502,371 B2
(45) Date of Patent: Jan. 7, 2003

(54) SELF-OPENING BAG

(75) Inventor: Robert B. DeMatteis, Grass Valley, CA (US)

(73) Assignee: Bob Dematteis Co., Grass Valley, CA (US)

( * ) Notice: Subject to any disclaimer, the term of this patent is extended or adjusted under 35 U.S.C. 154(b) by 101 days.

(21) Appl. No.: 09/796,120

(22) Filed: Feb. 27, 2001

(65) Prior Publication Data

US 2001/0029724 A1 Oct. 18, 2001

Related U.S. Application Data

(60) Provisional application No. 60/185,520, filed on Feb. 28, 2000.

(51) Int. Cl.[7] ..... B65B 43/26; B65D 33/01

(52) U.S. Cl. ..... 53/459; 53/572; 206/554; 383/37; 383/103

(58) Field of Search ..... 53/459, 571, 572; 206/554; 383/37, 103

(56) References Cited

U.S. PATENT DOCUMENTS 3,546,327 A * 12/1970 Ruda ..... 383/103
4,503,561 A * 3/1985 Bruno ..... 383/103
4,978,231 A * 12/1990 Ling et al. ..... 206/554
4,995,860 A * 2/1991 Wilfong, Jr. ..... 206/554
5,335,788 A * 8/1994 Beasley et al. ..... 206/554
5,362,152 A * 11/1994 Fletcher et al. ..... 383/103
5,630,779 A * 5/1997 Glod et al. ..... 493/204
5,738,893 A * 4/1998 Kornet et al. ..... 206/554
6,113,260 A 9/2000 Genrich et al.
6,113,269 A * 9/2000 DeMatteis et al. ..... 383/103
6,171,226 B1 1/2001 DeMatteis

* cited by examiner

*Primary Examiner*—John Sipos
(74) *Attorney, Agent, or Firm*—William Michael Hynes; Townsend and Townsend and Crew, LLP

(57) ABSTRACT

In the process of die-cutting bag stacks to form individual bag tops, die-cut handle apertures, or other mounting apertures, die blade configurations forming the vent lines of an array of vent apertures are also used to bond the outer surfaces of the front and rear bag walls together. The die-cutting operation selectively bonds the successive front and rear bag walls together at or adjacent the cut edges of the vent lines, thereby allowing the bags in a bag stack to subsequently self-open when dispensed.

9 Claims, 3 Drawing Sheets

SELF-OPENING BAG

CROSS-REFERENCES TO RELATED APPLICATIONS

This application references U.S. Provisional Patent Application No. 60/089,582, filed Jun. 17, 1998 by the named inventor herein entitled Plastic Bag Bundling System. Patent application Ser. No. 09/258,010, filed Feb. 25, 1999 entitled Plastic Bag Bundling System now U.S. Pat. No. 6,171,226 issued Jan. 9, 2001 is likewise incorporated by reference as if fully set forth herein.

This application references U.S. Provisional Patent Application No. 60/089,583, filed Jun. 17, 1998 by the named inventor herein and Don Pansier of Green Bay, Wis. entitled Automatic Ventilating System. U.S. patent application Ser. No. 09/258,033, filed Feb. 25, 1999 entitled Automatic Ventilating System now U.S. Pat. No. 6,113,269 issued Sep. 5, 2000 is likewise incorporated by reference as if fully set forth herein.

This application references U.S. Provisional Patent Application No. 60/092,232, filed Jul. 9, 1998 by the named inventor herein entitled Plastic Bag Manufacturing Process. U.S. patent application Ser. No. 09/257,843, filed Feb. 25, 1999 entitled Automatic Ventilating System now U.S. Pat. No. 6,186,933 issued Feb. 13, 2001 is likewise incorporated by reference as if filly set forth herein.

The above Patent Applications—and all of them—are herein incorporated by reference as if fully set forth herein with the subject matter of the present invention being independently patentable over all.

This invention relates to plastic bags and a method of effecting their self-opening ability. More specifically, this invention relates to plastic bags that are suspended on a releasable hook retaining means and are then efficaciously dispensed.

BACKGROUND OF THE INVENTION

The self-opening systems described in U.S. Pat. No. 6,171,226 entitled Plastic Bag Bundling System, incorporate methods of releasably bonding together bag mouths, die-cut handles and other related apertures and die-cuts at their die-cut edges or immediately adjacent the cut edges. The bonds at the bag mouth and die-cut handle edges will selectively cause the bags in the bag pack to self-open because the outer surfaces of the front and rear bag walls have a high coefficient of friction and the inside surfaces have a low coefficient of friction. The difference in coefficient of friction may be the result of corona treatment to the outer surfaces, the use of co-extruded films with layers that have a different coefficient of friction, or by applying a weak, diluted adhesive.

When applying the principles as described in U.S. Pat. No. 6,171,226 by using a high coefficient of friction on the outer film layers and lower coefficient of friction on the inside film layers to a bag incorporating the ventilating structure of U.S. Pat. No. 6,113,269, the self-opening of bags may be effected. Since Automatic Ventilating Systems (AVS) are created by a series of cut vent lines, the same bonding action that occurs when die-cutting a bag mouth or handle hole will also occur when die-cutting the vent lines.

Applying AVS is particularly beneficial with bags in which a "blouse-open" effect is desirable. This is because the cut lines of the AVS are located below the bag mouth region, in the body of the bag. Thus, when a bag is dispensed from a hook—for instance a handle hook—the bonding at the bag mouth and/or die-cut handle region may initiate the self-opening of the next bag in sequence, but the bonding at the cut vent lines of the AVS below the bag mouth and die-cut handle will tend to cause the bag body to also open wide. The advantage of having a bag that not only has the mouth open, but the body region below the mouth bloused-open, is that it is easier to load. This is particularly true when loading bags on a handle hook dispensing system.

SUMMARY OF THE INVENTION

In the process of die-cutting bag stacks to form individual bag tops, die-cut handle apertures, or other mounting apertures, die blade configurations forming the vent lines of AVS are also incorporated. Typically the outer surfaces of the front and rear bag walls have a high coefficient of friction and the inside surfaces have a low coefficient of friction.

As previously described, the film may be co-extruded, corona treated or a form of adhesive is used in order to accomplish the high and low coefficient of friction objectives.

Typically a single die board is used in a single die cutting operation that forms the bag top, handle aperture and AVS vent lines. The die-cutting operation selectively bonds the successive front and rear bag walls together at or adjacent the cut edges of the vent lines, thereby allowing the bags in a bag stack to subsequently self-open when dispensed.

DESCRIPTION OF THE SPECIFIC EMBODIMENTS

Figure 1:
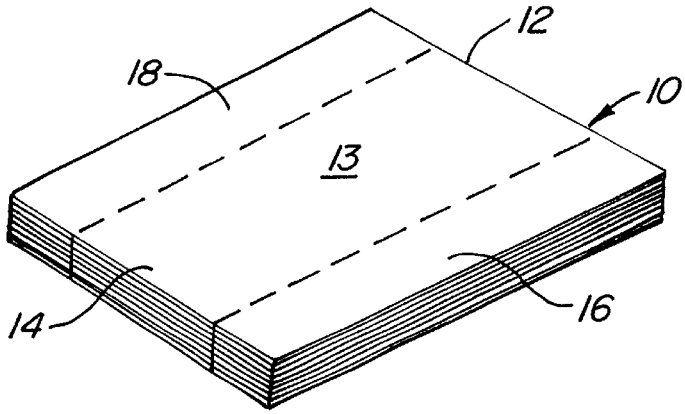
FIG. 1 is a perspective view of a stack of manufactured bags.

In FIG. 1 a stack of manufactured bags 10 has sealed bag bottoms 12 aligned one atop the other, bag tops 14 aligned one atop the other, bag bodies 13 aligned one atop the other, and left side gussets 16 and right side gussets 18 aligned one atop the other. This stack of manufactured bags is typical of most bag manufacturing processes after the bags have been cut and severed from tube stock and may number from 25 to 100 bags or more, depending upon size and gauge. In the case of manufactured bags such as those bags falling under U.S. Pat. No. 6,186,933, entitled Plastic Bag Manufacturing Process, a bag stack will be in the form of sealed tubes, which bag mouths will be formed upon a subsequent central die-cutting operation. Typically an electrostatic treater would have previously treated the front and rear bag wall surfaces of the bags in the bag stack as is commonly known in the art and then subsequently printed with a logo. Treating outer film surfaces is required to prepare the film for printing and may be the first step to prepare a bag stack of the present invention to self-open. For best self-opening effects on high-density film, the treatment may be as great as 50–52 dynes, with a decreasing effect thereafter. Some bi-modal resins, or those high-density resins blended with low-density resins, may reduce the treatment requirements to as low as 42 to 44 dynes. With films that are a lower density than traditional high density films, or of a co-extruded film with an outer skin layer of a lower density layer—this may be any one of the various types of low density resins, such as, but not limited to those made from butene, hexene or octene resins, and medium density or medium molecular weight resins and the newer metolacene resins—and an inside layer of high density, the dyne treatment tends to be less. Much is dependent upon the type of lower density (or "non-high density") resin used. For instance, some of these lower density resins have a high coefficient of friction, due to the having less, or the absence of, slip and anti-block compounds added in. The treat level on these films with low slip and anti-block properties may be as low as 38 dynes in order to achieve a proper self-opening effect under the present invention. But these films may also tend to severely block when wound on a roll after being extruded. Thus, unwinding them for subsequent printing and converting into bags may result in substantial scrap. With lower density resins that have sufficient slip and anti-block compounds added in to minimize blocking on an extruded roll of film, the dyne level may need to be as great as 42 to 44. Treating co-extruded films for subsequent self-opening effects is commonly known and was originally pioneered by Polytec Packaging Systems or Riverside Calif. in 1989 and subsequently discussed in U.S. Pat. No. 5,335,788 Beasley, et al, and U.S. Pat. No. 5,087,234 Prader, et al. But using these methods in combination with the methods taught in the present invention provides a unique, superior self-opening bag pack.

Figure 2:
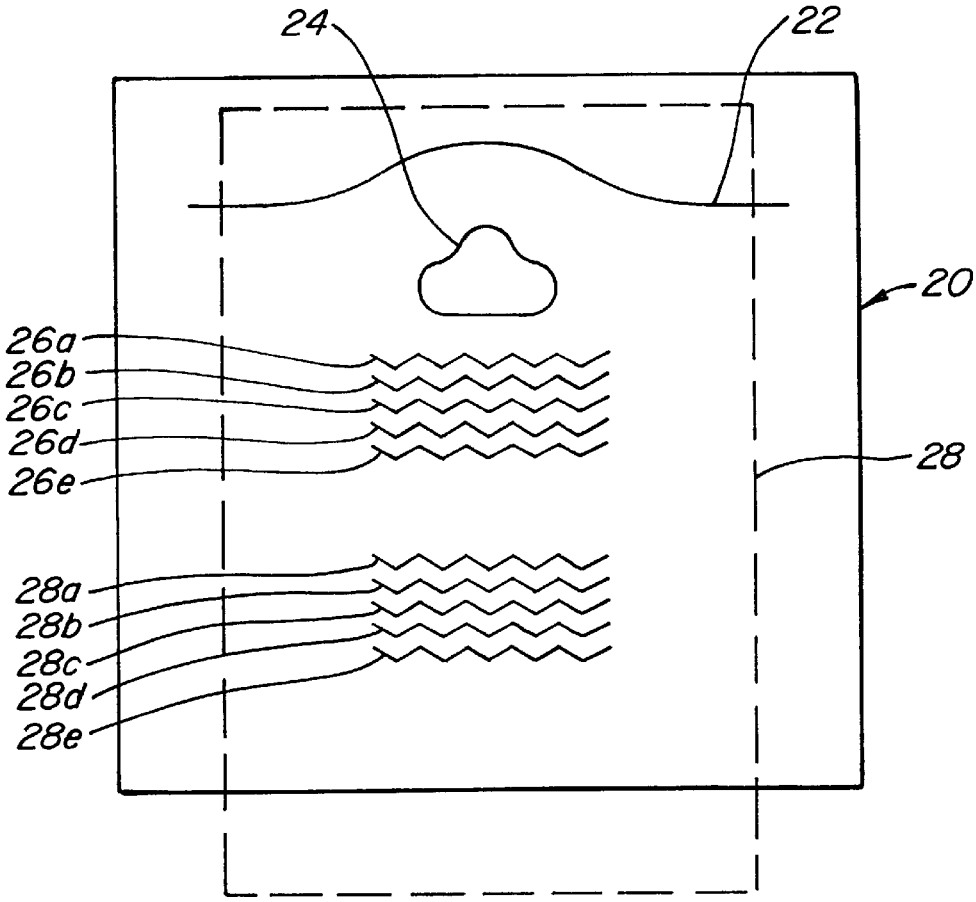
FIG. 2 is a plan view of a die board for cutting bag stacks.

In FIG. 2 die board 20 has a die blade 22 that will form a wave top mouth on the bags in the stack, a die blade 24 that will form two handle holes per bag, one in the rear bag wall and one in the front bag wall, and a series of die blades 26*a*, 26*b*, 26*c*, 26*d* and 26*e* and 28*a*, 28*b*, 28*c*, 28*d* and 28*e* that together will form two sets of vent lines in the bag body 13 of FIG. 1. Approximate alignment of the die with the upper region of a stack of bags is illustrated by dotted lines 28. It is not important whether there are one or two sets of vent lines or how many vent lines are in a set in order for the present invention to have the desired outcome. However, the more vent lines there are, generally speaking, the more desirable will be the self-opening effect. The cut vent lines will be typical of those illustrated in U.S. Pat. No. 6,113,269, entitled Automatic Ventilating System. In die blades that would be used in the bags made from the previously mentioned U.S. Pat. No. 6,186,933, the die board would tend to be a single board with 2 sets of opposing blades, which would cut and sever the sealed bag stack into two individual opposing bag stacks as described in the subject application. Regardless of which process is used, the result of applying the principles of the present invention is essentially the same.

Figure 3:
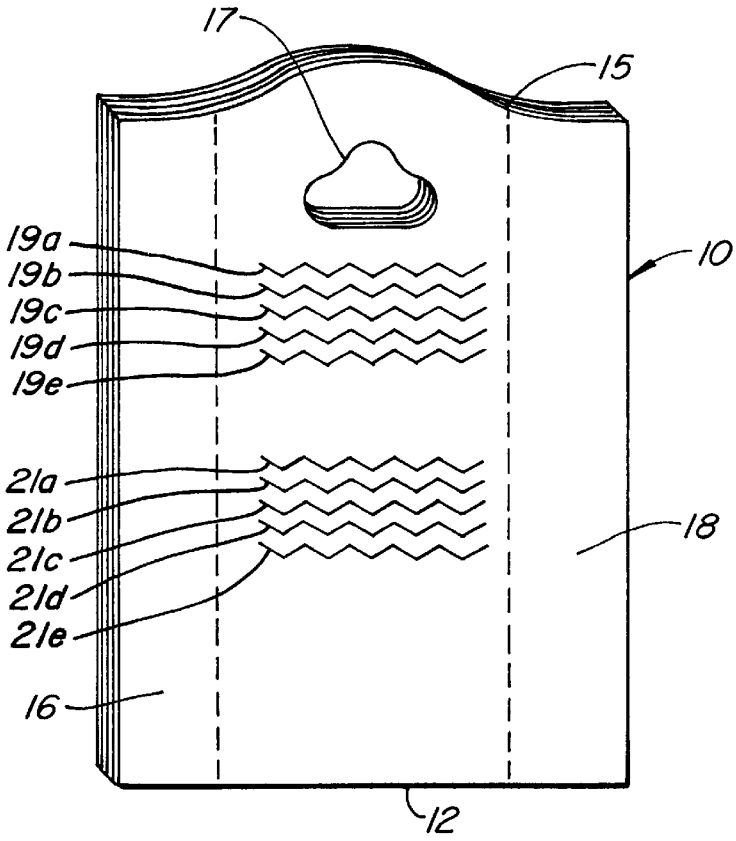
FIG. 3 is a perspective view of the stack of bags in FIG. 2 after they have been die-cut by the die board of FIG. 2.

In FIG. 3 bag stack 10 has been die-cut by the die board of FIG. 3, and now has aligned, openable wave-top bag mouths 15, aligned bag bottoms 12, aligned die-cut handle holes 17, aligned left side gussets 16 and right side gussets 18, and aligned die-cut vent lines 19*a*, 19*b*, 19*c*, 19*d* and 19*e*, and 21*a*, 21*b*, 21*c*, 21*d* and 21*e*. The die-cut vent lines 19*a*, 19*b*, 19*c*, 19*d* and 19*e*, and 21*a*, 21*b*, 21*c*, 21*d* and 21*e* are in accordance to the present invention thereby having releasable bonds between the outer surfaces of the front and rear bag walls at the cut lines. Typically it would be desirable to also have the wave-tops 15 and the die-cut handles 17 made according to the teachings of at least one of the bag systems illustrated in U.S. Pat. No. 6,171,326 in order to releasably bond the pack of bags together in a bundle and improve the self-opening effect upon dispensing.

Figure 4:
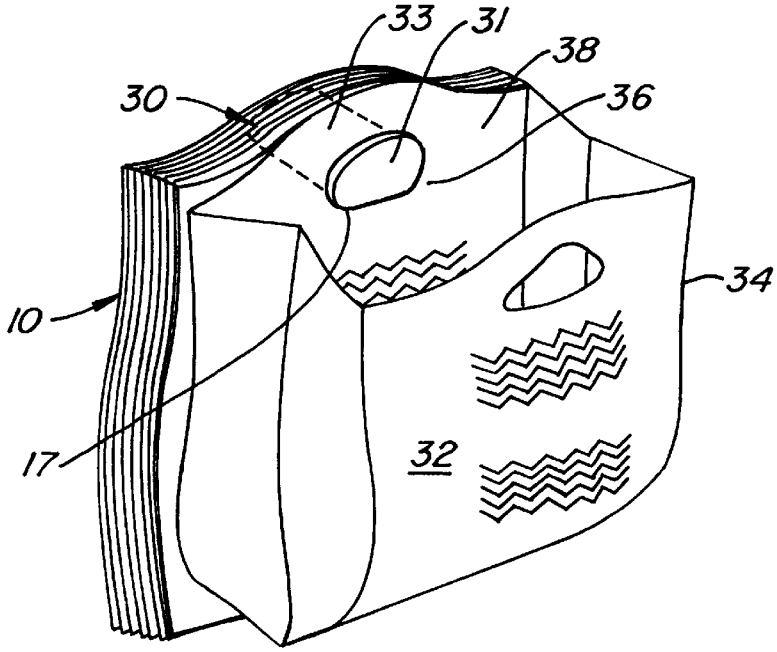
FIG. 4 is a perspective view of the bags in the bag stack of FIG. 3 mounted on a retaining hook.

In FIG. 4 bag stack 10 is mounted onto retaining hook 30 by threading the aligned die-cut handles 17 onto retaining hook 30 and retained in place by hook lip 31, which rises above shaft 33 by a distance of about ½" to ¾", sufficient to retain the bag pack on the hook. The front wall 32 of the forward-most bag 34 is free from hook 30 in an opened position, while the rear wall 38 of forward-most bag 34 is retained at rear handle hole 36 on hook lip 31, thus allowing a user to load forward-most bag 34. While forward-most bag 34 is suspended on hook 30 a user may load forward-most bag 34 with merchandise since it is supported by the die-cut handle hole 36 on its rear wall 38 on hook 30 and secured behind lip 31. It is this opened position that is desirable for the high productivity dispensing and loading in high volume applications, such as fast food restaurants.

Figure 5:
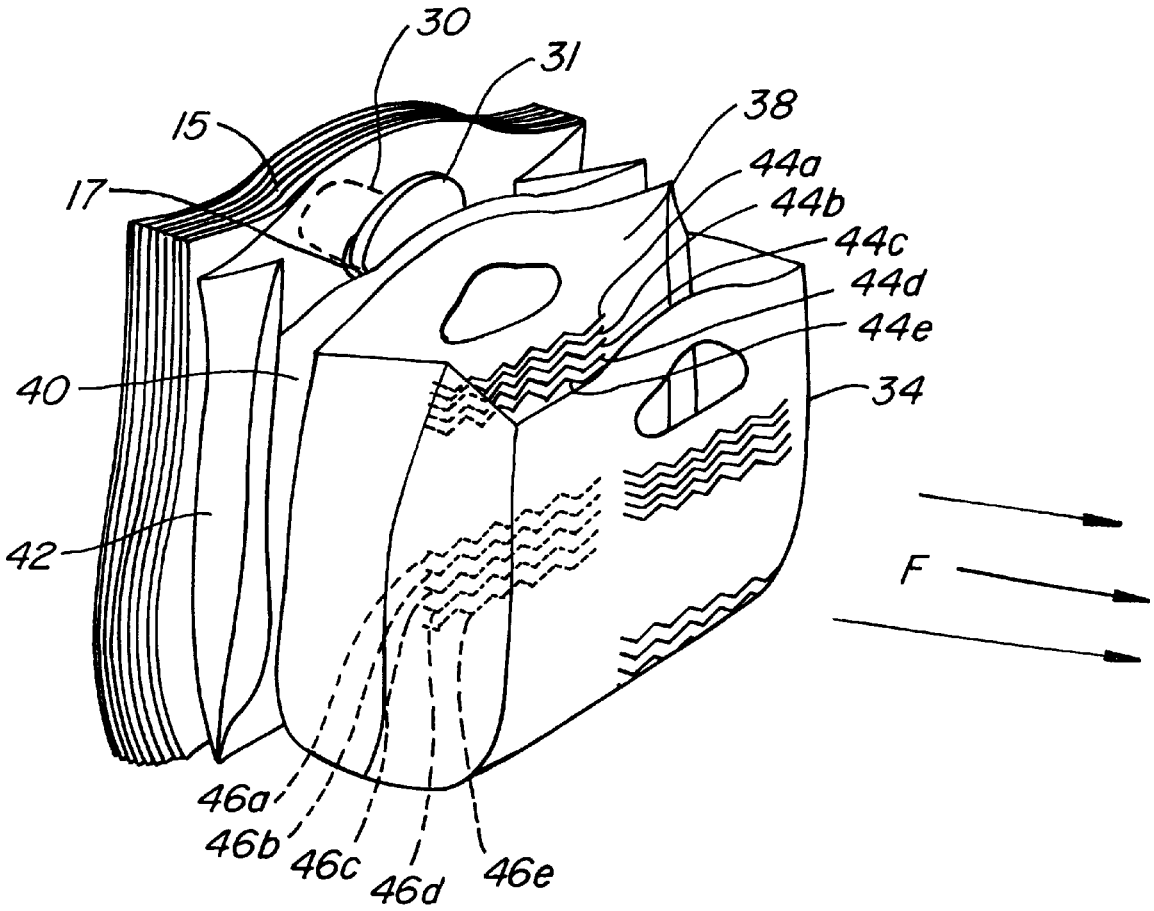
FIG. 5 is a cartoon view of the bags in FIG. 4 being dispensed and self-opened from a retaining hook.

In FIG. 5 forward-most bag 34 is shown fully dispensed from, and free of, hook 30 and hook lip 31. Cut through rear wall 38 of forward-most bag 34 and cut through front wall 40 of next-bag-in-sequence 42, cut vent-lines 44*a*, 44*b*, 44*c*, 44*d* and 44*e* and 46*a*, 46*b*, 46*c*, 46*d* and 46*e* form releasable bonds between the two bag walls. Upon exerting force F, the releasable bonds between vent lines 44*a*, 44*b*, 44*c*, 44*d* and 44*e* and 46*a*, 46*b*, 46*c*, 46*d* and 46*e* has caused the rear wall 38 of forward-most bag 34 to pull over hook lip 31 and likewise entrailing front wall 40 of next-bag-in-sequence 42 to also pull over hook lip 31 and free of hook 30. Once the last releasable bond in the cut vent lines between the front and rear bag walls breaks free, the next-bag-in-sequence 42 will look much like that of bag 34 in FIG. 4 and ready for loading by the user. It is noted that this self-opening effect may be enhanced by releasable bonds formed between front and rear bags walls in the die-cutting operation that forms the wave tops 15 and the die-cut handles 17. In the case of the releasably bonded die-cut wave tops and die-cut handles causing the self-opening of a bag, the releasably bonded cut vent lines will further cause the bag body to blouse wide open when dispensed, further enhancing the ability of the user to load the next-bag-in-sequence when it become the forward-most bag.

What is claimed is:

1. A process of serially dispensing and opening a bag from a bundle of bags comprising the steps of:

providing a bundle of bags having at least a leading bag and a plurality of trailing bags with each bag of the bundle of bags having:

a front bag wall having a top, a bottom, and two parallel side edges;

a rear bag wall having a top, a bottom, and two parallel side edges;

two bag sides, each bag side joining one of the side edges of the front bag wall to one of the side edges of the rear bag wall to form a closed continuum around the front bag wall and the rear bag wall;

a bottom joining the bottom of the front bag wall and the bottom of the rear bag wall to form a closed bottom to the closed continuum of the bag;

cutting the bundle of bags to define;

at least one front support handle fastened to the front bag wall;

at least one rear support handle fastened to the rear bag wall;

a top to the bag which can be opened to receive articles within the bag;

an array of vent apertures at a central portion of the front and rear bag walls, said array including rows of said vent apertures with adjacent apertures being spaced along a respective row of the array by a connection, said cutting providing bonds of the rear bag wall of a leading bag joined the front bag wall of a trailing bag at the array of vent apertures, the bonds releasing under a release force;

providing at least one support for the front support handle and the rear support handle;

threading the front support handle and the rear support handle to the bags in the bag bundle to the support;

pulling on the front bag wall of the leading bag to release the front support handle of the leading bag from the support;

continuing pulling on the front bag wall of the leading bag to release the rear support handle of the leading bag and the front support handle of the trailing bag from the support whereby the bonds of the leading bag pulls on the bonds of the trailing bag to release both the rear support handle of the leading bag and the front support handle of the trailing bag from the support;

continuing pulling on the front bag wall of the leading bag whereby the bonds attaching the rear bag wall of the leading bag to the front bag wall of the trailing bag has the release force exceeded to cause separation of the leading bag from the trailing bag in a bag open disposition.

2. The process of serially dispensing and opening a bag from a bundle of bags according to claim 1 and wherein:

said cutting providing bonds of the rear bag wall of a leading bag joined the front bag wall of a trailing bag at the support handle.

3. The process of serially dispensing and opening a bag from a bundle of bags according to claim 1 and wherein:

said cutting providing bonds of the rear bag wall of a leading bag joined the front bag wall of a trailing bag at the top.

4. A bundle of bags comprising:

a bundle of bags having at least a leading bag and a plurality of trailing bags with each bag of the bundle of bags having:

a front bag wall having a top, a bottom, and two parallel side edges;

a rear bag wall having a top, a bottom, and two parallel side edges;

two bag sides, each bag side joining one of the side edges of the front bag wall to one of the side edges of the rear bag wall to form a closed continuum around the front bag wall and the rear bag wall;

a bottom joining the bottom of the front bag wall and the bottom of the rear bag wall to form a closed bottom to the closed continuum of the bag;

the bundle of bags being cut to define;

at least one front support handle fastened to the front bag wall;

at least one rear support handle fastened to the rear bag wall;

a top to the bag which can be opened to receive articles within the bag;

an array of vent apertures at a central portion of the front and rear bag walls, said array including rows of said vent apertures with adjacent apertures being spaced along a respective row of the array by a connection, said cutting at said vent apertures having bonds of the rear bag wall of a leading bag joined the front bag wall of a trailing bag at the array of vent apertures, the bonds releasing under a release force whereby;

when the bag bundles is threaded to a support for the front support handle and the rear support handle to support the bags in the bag bundle from the support;

pulling on the front bag wall of the leading bag to release the front support handle of the leading bag from the support;

continuing pulling on the front bag wall of the leading bag to release the rear support handle of the leading bag and the front support handle of the trailing bag from the support whereby the bonds of the leading bag pulls on the bonds of the trailing bag to release both the rear support handle of the leading bag and the front support handle of the trailing bag from the support;

continuing pulling on the front bag wall of the leading bag whereby the bonds attaching the rear bag wall of the leading bag to the front bag wall of the trailing bag has the release force exceeded to cause separation of the leading bag from the trailing bag in a bag open disposition.

5. The bundle of bags according to claim 4 comprising:

wherein the exterior of said bags includes low density resins having a high coefficient of friction.

6. The bundle of bags according to claim 4 comprising:

wherein the interior of said bags includes high density resins having a low coefficient of friction.

7. A bundle of bags having at least a leading bag and a plurality of trailing bags with each bag of the bundle of bags lacking discrete tags for bag support and having:

a front bag wall having a top, a bottom, and two parallel side edges;

a rear bag wall having a top, a bottom, and two parallel side edges;

two bag sides, each bag side joining one of the side edges of the front bag wall to one of the side edges of the rear bag wall to form a closed continuum around the front bag wall and the rear bag wall;

a bottom joining the bottom of the front bag wall and the bottom of the rear bag wall to form a closed bottom to the closed continuum of the bag;

the bundle of bags cut to form a plurality of cuts, the cuts further defining;

at least one front support handle fastened to the front bag wall;

at least one rear support handle fastened to the rear bag wall, a top to the bag which can be opened to receive articles within the bag an array of vent apertures at a central portion of the front and rear bag walls, said array including rows of said vent apertures with adjacent apertures being spaced along a respective row of the array by a connection, the cuts defining releasable bonds between the rear bag wall of a leading bag joined to the front bag wall of a trailing bag, the releasable bond being formed at at least the vent apertures and releasing under a force whereby the bags are fastened in a bundle.

8. The bundle of bags according to claim 7 and wherein:

said cutting providing bonds of the rear bag wall of a leading bag joined the front bag wall of a trailing bag at the support handle.

9. The bundle of bags according to claim 7 and wherein:

said cutting providing bonds of the rear bag wall of a leading bag joined the front bag wall of a trailing bag at the bag top.

* * * * *